US006520620B1

(12) United States Patent
Askren et al.

(10) Patent No.: US 6,520,620 B1
(45) Date of Patent: Feb. 18, 2003

(54) GEAR TRAIN FOR A MAINTENANCE STATION OF AN INK-JET PRINTER

(75) Inventors: Benjamin Alan Askren, Lexington, KY (US); John Edward Borsuk, Nicholasville, KY (US); Donn Duane Bryant, Lexington, KY (US); Edward Lawrence Kiely, Lexington, KY (US); Robert Flynt Strean, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/557,798

(22) Filed: Apr. 25, 2000

(51) Int. Cl.[7] ..... B41J 2/165
(52) U.S. Cl. ..... 347/32; 347/30
(58) Field of Search ..... 347/32, 30, 23, 347/22, 33, 28, 29

(56) References Cited

U.S. PATENT DOCUMENTS 3,406,583 A * 10/1968 Baier ..... 74/411
3,446,085 A * 5/1969 Ginsberg ..... 74/89.14
4,825,231 A * 4/1989 Nozaki ..... 347/30
5,051,761 A 9/1991 Fisher et al.
5,382,969 A 1/1995 Mochizuki et al.
5,448,271 A * 9/1995 Yamaguchi et al. ..... 347/30
5,587,729 A 12/1996 Lee et al.
5,801,725 A 9/1998 Neese et al.
5,812,157 A 9/1998 Nguyen et al.
5,980,018 A * 11/1999 Taylor et al. ..... 347/31
6,119,538 A * 1/2000 Chang ..... 74/89.15

FOREIGN PATENT DOCUMENTS

EP 604067 * 6/1994

* cited by examiner

*Primary Examiner*—Thinh Nguyen
*Assistant Examiner*—Ly T Tran
(74) *Attorney, Agent, or Firm*—Elizabeth C. Jacobs

(57) ABSTRACT

A maintenance station of an ink-jet printer includes a maintenance carrier. The maintenance carrier has a plurality of positions, including a pumping position. A respective maintenance function is enabled in each of the positions. A pump pumps ink when the maintenance carrier is in the pumping position. A gear train both translates the maintenance carrier between the plurality of positions and actuates the pump. A single motor drives the gear train to thereby translate the maintenance carrier and actuate the pump.

22 Claims, 2 Drawing Sheets

GEAR TRAIN FOR A MAINTENANCE STATION OF AN INK-JET PRINTER

BACKGROUND OF THE INVENTION

1. Field of the Invention

The present invention relates to a maintenance station of an ink-jet printer, and, more particularly, to a gear train for a maintenance station of an ink-jet printer.

2. Description of the Related Art

The ink-ejecting nozzles of an ink-jet printer sometimes get clogged with coagulated ink and/or contaminations. In order to improve print quality, it is known for an ink-jet printer to be provided with a maintenance station that performs four basic independent functions. First, the maintenance station performs capping of the printheads in order to insure that the printheads do not dry out during idle/power-off. Second, the maintenance station performs wiping of the nozzle plate in order to clear the nozzle plate of debris. Third, the maintenance station performs spitting of ink through the nozzles in order to clear the nozzles of wiping debris. Fourth, the maintenance station performs pumping in order to remove from the ink any micro-bubbles which may develop after printhead installation.

In order to perform these functions, most ink-jet maintenance stations include a power transmission system having a gear train and at least two, and sometimes three, motors. A problem is that each additional motor increases the cost and space requirements of the maintenance station.

What is needed in the art is maintenance station that uses only one motor to perform the four functions of capping, wiping, spitting and pumping.

SUMMARY OF THE INVENTION

The present invention provides a gear train which utilizes several key components in order to independently perform the four basic functions of a maintenance station, i.e., capping, wiping, spitting and pumping, while using only one motor.

The invention comprises, in one form thereof, a maintenance station of an ink-jet printer. A maintenance carrier has a plurality of positions, including a pumping position. A respective maintenance function is enabled in each of the positions. A pump pumps ink when the maintenance carrier is in the pumping position. A gear train both translates the maintenance carrier between the plurality of positions and actuates the pump. A single motor drives the gear train to thereby translate the maintenance carrier and actuate the pump.

An advantage of the present invention is that only one motor is required to perform all four maintenance functions, i.e., capping, wiping, spitting, and pumping.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction, the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
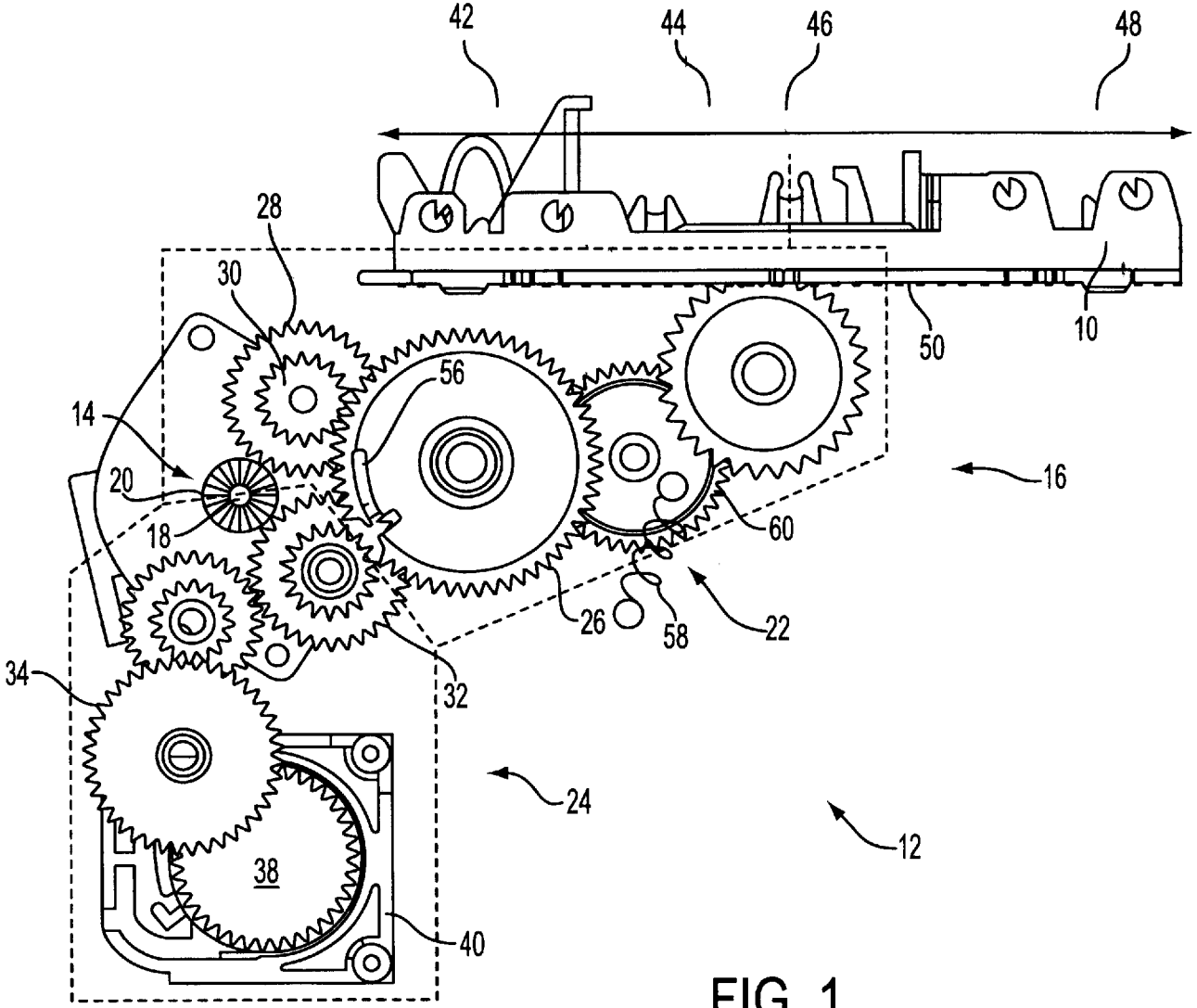
FIG. 1 side view of a maintenance carrier and one embodiment of a power transmission system of the present invention.

Referring now to the drawings and particularly to FIG. 1, there is shown a maintenance carrier 10 and one embodiment of a power transmission system 12 of the present invention. Power transmission system 12 includes a motor assembly 14 and a gear train 16. Motor assembly 14 includes a motor 18 and a toothed pinion 20.

Figure 2:
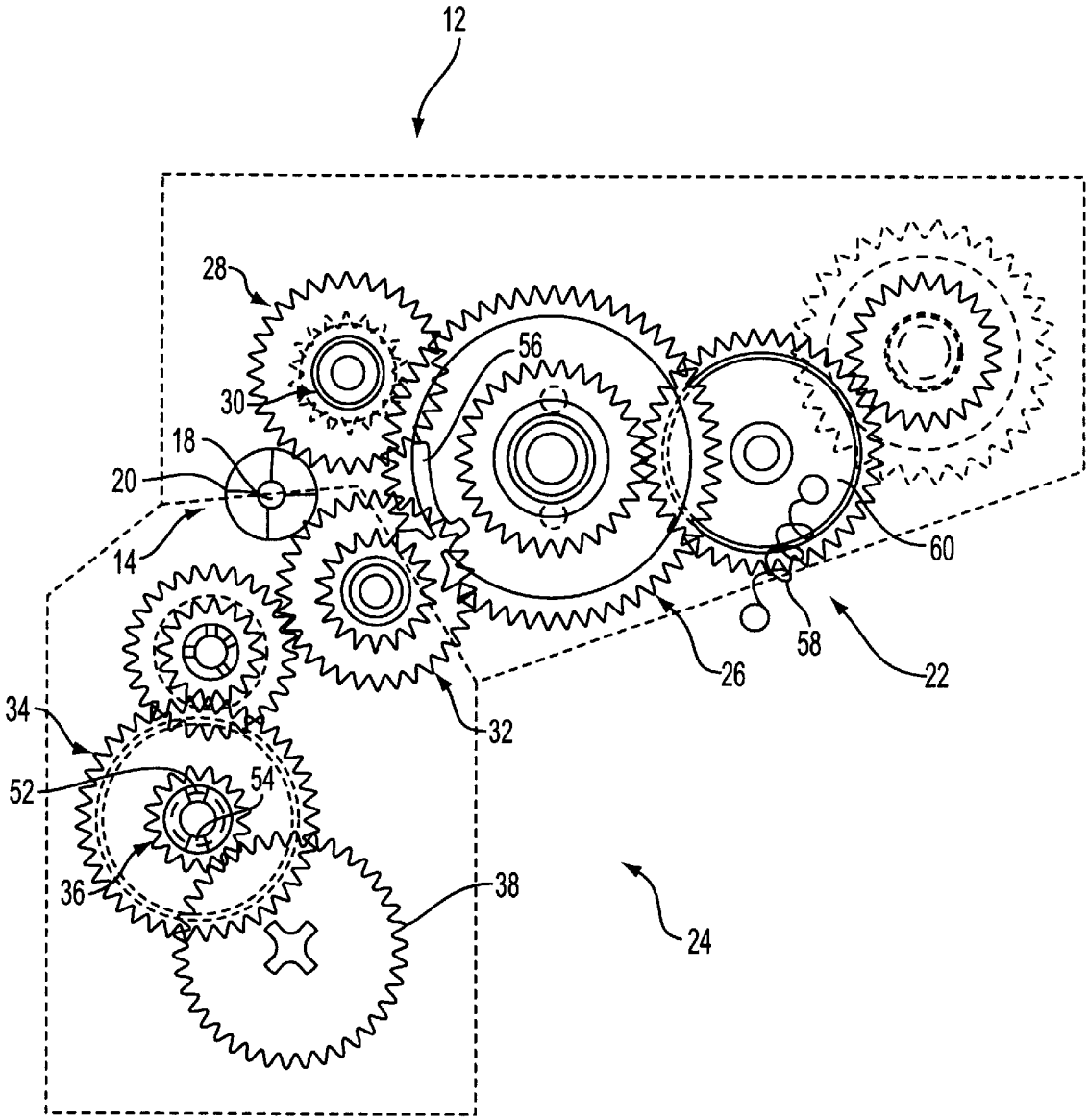
FIG. 2 is an enlarged, side view of the power transmission system of FIG. 1.

Gear train 16 includes a positioning branch 22 and a pumping branch 24, both of which emanate from motor pinion 20. Positioning branch 22 controls the positioning of maintenance carrier 10. Pumping branch 24 controls the pumping function. Within branches 22 and 24, there are several key components that allow maintenance station 10 to independently perform the basic functions of capping, wiping, spitting and pumping. These key components include a sector gear 26, a clutch gear 28, a one-way clutch 30, a drive gear 32, a first lost motion gear 34, a second lost motion gear 36 (FIG. 2), a pump gear 38, and a pump 40.

The maintenance station has four linear positions, i.e., pump position 42, wipe position 44, spit position 46 and cap position 48. The four positions are in alignment, with pump position 42 being on one end of the alignment. Maintenance carrier 10 must be placed in a respective one of the four positions in order to perform a particular function, such as capping, wiping, spitting or pumping.

In operation, rotary pump 40 must be actuated in pumping position 42 and independent of the other three positions 44, 46 and 48. Gear train 16 translates maintenance carrier 10 into the four positions 42, 44, 46 and 48. Gear train 16 also translates maintenance carrier 10 into pump position 42 while actuating rotary pump 40.

The rotary motion of positioning branch 22 of gear train 16 meshes with maintenance carrier 10 through a rack 50 which is integral with maintenance carrier 10. Thusly, positioning branch 22 of gear train 16 allows maintenance carrier 10 to be translated into the four linear positions 42, 44, 46 and 48.

As maintenance carrier 10 approaches pump position 42, an axially protruding dog 52 on lost motion gear 34 engages a mating axially protruding dog 54 on lost motion gear 36, thereby initiating rotation of lost motion gear 36. The rotation of lost motion gear 36 results in the transmission of power to rotary pump 40. At the point maintenance carrier 10 reaches pump position 42, a cutout portion 56 of sector gear 26 encircles clutch gear 28. With sector gear 26 in this position, motor 18 continues to rotate in the current direction, continuing to actuate pump 40 without translating maintenance carrier 10.

In order to guarantee that maintenance carrier 10 fully reaches pump position 42 after sector gear 26 encircles clutch gear 28, a spring 58 is attached to an idle gear 60 as shown. Spring 58 pulls the last two positioning gears and maintenance carrier 10 toward a hard stop, which is pump position 42. By biasing maintenance carrier 10 against a hard stop in pump position 42, the positional timing of maintenance carrier 10 is maintained.

When actuation of pump 40 is needed, the lost motion features in pumping branch 24, i.e., dogs 52 and 54 of lost motion gear 34 and lost motion gear 36, respectively, engage each other, thereby initiating rotation of pump gear 38. This occurs when carrier 10 is either close to or in pump position 42. These same lost motion features, i.e., dogs 52, 54, disengage when pump actuation is undesirable. This occurs in spit position 46 and in wipe position 44, where speed of the system is most critical.

In order to move carrier 10 from pump position 42, motor 18 rotates in the opposite direction. In this direction, one-way clutch 30 "catches" and sector gear 26 moves back into engagement with drive gear 32.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A maintenance station of an ink-jet printer, said maintenance system comprising:

a maintenance carrier having a plurality of positions, said positions including a pumping position, a respective maintenance function being enabled in each of said positions;

a pump configured for pumping ink when said maintenance carrier is in said pumping position;

a gear train configured for both translating said maintenance carrier between said plurality of positions and actuating said pump; and a single motor configured for driving said gear train to thereby translate said maintenance carrier and actuate said pump.

2. The maintenance station of claim 1, wherein said gear train is coupled to each of said maintenance carrier and said pump.

3. The maintenance station of claim 1, wherein said single motor is coupled to said gear train.

4. The maintenance station of claim 1, wherein said gear train includes a positioning branch and a pumping branch, said positioning branch being configured for translating said maintenance carrier, said pumping branch being configured for actuating said pump, each of said positioning branch and said pumping branch emanating from said single motor.

5. The maintenance station of claim 1, further comprising a pinion interconnecting said motor and said gear train.

6. The maintenance station of claim 1, wherein said gear train is configured such that said maintenance carrier is not translated while said pump is being actuated.

7. The maintenance station of claim 1, wherein said gear train is configured such that said pump is not actuated while said maintenance carrier is being translated.

8. The maintenance station of claim 1, wherein a number of said positions is greater than two.

9. The maintenance station of claim 1, wherein said positions further include a capping position.

10. The maintenance station of claim 9, wherein said positions further include a wiping position.

11. The maintenance station of claim 10, wherein said positions further include a spitting position.

12. The maintenance station of claim 1, wherein said maintenance carrier includes a rack engaging said gear train.

13. A maintenance station of an ink-jet printer, said maintenance system comprising:

a maintenance carrier having a plurality of positions, said positions including a pumping position, a respective maintenance function being enabled in each of said positions;

a pump configured for pumping ink when said maintenance carrier is in said pumping position;

a gear train configured for both translating said maintenance carrier between said plurality of positions and actuating said pump, said gear train including a positioning branch and a pumping branch, said positioning branch being configured for translating said maintenance carrier, said pumping branch being configured for actuating said pump, said pumping branch including a first lost motion gear with a first axially protruding dog, said pumping branch also including a second lost motion gear with a second axially protruding dog, said first axially protruding dog being configured for being disengaged from said second axially protruding dog when said maintenance carrier is out of said pumping position, said first axially protruding dog being configured for being engaged with and driving said second axially protruding dog when said maintenance carrier is in said pumping position; and a single motor configured for driving said gear train to thereby translate said maintenance carrier and actuate said pump, each of said positioning branch and said pumping branch emanating from said single motor.

14. A maintenance station of an ink-jet printer, said maintenance system comprising:

a maintenance carrier having a plurality of positions, said positions including a pumping position, a respective maintenance function being enabled in each of said positions;

a pump configured for pumping ink when said maintenance carrier is in said pumping position;

a gear train configured for both translating said maintenance carrier between said plurality of positions and actuating said pump, said gear train including a positioning branch and a pumping branch, said positioning branch being configured for translating said maintenance carrier, said pumping branch being configured for actuating said pump, said positioning branch including a gear with a cutout portion, said cutout portion comprising a means for suspending translation of said maintenance carrier while said pump is being actuated; and a single motor configured for driving said gear train to thereby translate said maintenance carrier and actuate said pump, each of said positioning branch and said pumping branch emanating from said single motor.

15. A maintenance station of an ink-jet printer, said maintenance system comprising:

a maintenance carrier having a plurality of positions, said positions including a pumping position, a respective maintenance function being enabled in each of said positions;

a pump configured for pumping ink when said maintenance carrier is in said pumping position;

a gear train configured for both translating said maintenance carrier between said plurality of positions and actuating said pump; and a single motor configured for driving said gear train to thereby translate said maintenance carrier and actuate said pump;

wherein said gear train includes a positioning branch and a pumping branch, said positioning branch being configured for translating said maintenance carrier, said pumping branch being configured for actuating said pump, each of said positioning branch and said pumping branch emanating from said single motor; and wherein said single motor is configured for simultaneously driving said positioning branch and said pumping branch.

16. A maintenance station of an ink-jet printer, said maintenance system comprising:

a maintenance carrier having a plurality of positions, said positions including a pumping position, a respective maintenance function being enabled in each of said positions;

a pump configured for pumping ink when said maintenance carrier is in said pumping position;

a gear train configured for both translating said maintenance carrier between said plurality of positions and actuating said pump; and a single motor configured for driving said gear train to thereby translate said maintenance carrier and actuate said pump;

wherein a number of said positions is greater than three.

17. A maintenance station of an ink-jet printer, said maintenance system comprising:

a maintenance carrier having a plurality of positions, said positions including a pumping position, a respective maintenance function being enabled in each of said positions;

a pump configured for pumping ink when said maintenance carrier is in said pumping position;

a gear train configured for both translating said maintenance carrier between said plurality of positions and actuating said pump; and a single motor configured for driving said gear train to thereby translate said maintenance carrier and actuate said pump;

wherein said positions of said maintenance carrier are disposed substantially in an alignment with each other, said pumping position being disposed on an end of said alignment.

18. A positioning system for a maintenance station of an ink-jet printer, the maintenance system including a pump for pumping ink, said positioning system comprising:

a maintenance carrier having a plurality of positions, said positions including a pumping position configured for enabling the pump to pump the ink, a respective maintenance function being enabled in each of said positions;

a gear train configured for both translating said maintenance carrier between said plurality of positions and actuating the pump; and a single motor configured for driving said gear train to thereby translate said maintenance carrier and actuate the pump.

19. The positioning system of claim 18, wherein the plurality of positions of said maintenance carrier are disposed substantially in alignment with each other.

20. A power transmission system for a translating a maintenance carrier of a maintenance station of an ink-jet printer, the maintenance carrier having a plurality of linear positions, the positions including a pumping position, the maintenance station including a pump for pumping ink when the maintenance carrier is in the pumping position, said power transmission system comprising:

a gear train configured for both translating the maintenance carrier between the plurality of linear positions and actuating the pump; and a single motor configured for driving said gear train to thereby translate the maintenance carrier and actuate the pump.

21. The maintenance station of claim 1, wherein said gear train includes a first gear with a first axially protruding dog, said gear train also including a second gear with a second axially protruding dog, said first axially protruding dog being configured for being disengaged from said second axially protruding dog when said maintenance carrier is out of said pumping position, said first axially protruding dog being configured for being engaged with and driving said second axially protruding dog when said maintenance carrier is in said pumping position.

22. The maintenance station of claim 1, wherein said gear train includes a gear with a cutout portion, said cutout portion being configured to suspend translation of said maintenance carrier while said pump is being actuated.

* * * * *